US009573389B2

(12) United States Patent
Gould et al.

(10) Patent No.: US 9,573,389 B2
(45) **Date of Patent: *Feb. 21, 2017**

(54) INK-JET PRINTING METHOD

(75) Inventors: Nigel Gould, Broadstairs (GB); Jeremy Ward, Broadstairs (GB); Robert Augustus Fassam, Broadstairs (GB); Barry McGregor, Broadstairs (GB)

(73) Assignee: Sericol Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/983,019

(22) PCT Filed: Feb. 14, 2012

(86) PCT No.: PCT/GB2012/050329

§ 371 (c)(1),
(2), (4) Date: Oct. 8, 2013

(87) PCT Pub. No.: WO2012/110802

PCT Pub. Date: Aug. 23, 2012

(65) Prior Publication Data

US 2014/0063154 A1 Mar. 6, 2014

(30) Foreign Application Priority Data

Feb. 14, 2011 (GB) ..... 1102548.3
Jun. 10, 2011 (GB) ..... 1109746.6

(51) Int. Cl.
*B41J 2/21* (2006.01)
*B41J 11/00* (2006.01)
(Continued)

(52) U.S. Cl.
CPC ..... *B41J 11/002* (2013.01); *B41M 7/0081* (2013.01); *B41M 5/0023* (2013.01)

(58) Field of Classification Search
USPC ..... 347/102, 101, 100
See application file for complete search history.

(56) References Cited

U.S. PATENT DOCUMENTS 5,623,001 A * 4/1997 Figov ..... 522/84
6,145,979 A * 11/2000 Caiger et al. ..... 347/102
(Continued)

FOREIGN PATENT DOCUMENTS

CN 1657288 A 8/2005
EP 1586459 A1 10/2005
(Continued)

OTHER PUBLICATIONS

Sericol Limited (GB 0920271.4), Printing Ink.*
(Continued)

*Primary Examiner* — Manish S Shah
(74) *Attorney, Agent, or Firm* — Wood, Phillips, Katz, Clark & Mortimer

(57) ABSTRACT

The present invention provides a method of inkjet printing comprising the following steps, in order: (i) providing a hybrid inkjet ink comprising an organic solvent, a radiation-curable material, a photoinitiator and optionally a colorant; (ii) printing the ink on to a substrate; (iii) pinning the ink by exposing the ink to actinic radiation at a dose of 1-200 mJ/cm$^2$; (iv) evaporating at least a portion of the solvent from the ink; and (v) exposing the ink to additional actinic radiation to cure the ink.

15 Claims, 7 Drawing Sheets

(51) Int. Cl.
*B41M 7/00* (2006.01)
*B41M 5/00* (2006.01)

(56) References Cited

U.S. PATENT DOCUMENTS

| | | | | |
|---|---|---|---|---|
| 6,558,753 | B1 * | 5/2003 | Ylitalo et al. | 427/466 |
| 6,726,317 | B2 * | 4/2004 | Codos | 347/106 |
| 7,297,454 | B2 * | 11/2007 | Ma et al. | 430/33 |
| 7,681,978 | B2 * | 3/2010 | Hirato | 347/19 |
| 8,801,165 | B2 * | 8/2014 | Fassam et al. | 347/100 |
| 8,807,731 | B2 * | 8/2014 | Takeuchi et al. | 347/102 |
| 2002/0005870 | A1 * | 1/2002 | Codos et al. | 347/9 |
| 2002/0044188 | A1 * | 4/2002 | Codos | 347/106 |
| 2002/0191063 | A1 * | 12/2002 | Gelbart et al. | 347/101 |
| 2004/0075726 | A1 * | 4/2004 | Hirai | 347/102 |
| 2005/0174412 | A1 * | 8/2005 | Codos et al. | 347/102 |
| 2006/0075917 | A1 * | 4/2006 | Edwards | 101/483 |
| 2006/0230969 | A1 * | 10/2006 | Vosahlo | 101/488 |
| 2007/0039517 | A1 * | 2/2007 | Tsuchimura | 106/14.31 |
| 2007/0125260 | A1 * | 6/2007 | Grimm et al. | 106/31.6 |
| 2007/0296790 | A1 * | 12/2007 | Nakazawa et al. | 347/102 |
| 2008/0174650 | A1 * | 7/2008 | Nakazawa | B41J 11/002 347/102 |
| 2008/0198189 | A1 * | 8/2008 | Vanhooydonck et al. | 347/9 |
| 2008/0239045 | A1 * | 10/2008 | Umebayashi | C09D 11/101 347/102 |
| 2009/0244116 | A1 * | 10/2009 | Ohnishi | 347/6 |
| 2009/0244230 | A1 | 10/2009 | Ohnishi et al. | |
| 2011/0148979 | A1 * | 6/2011 | Breton et al. | 347/20 |
| 2011/0298876 | A1 * | 12/2011 | Takeuchi et al. | 347/102 |
| 2012/0206534 | A1 * | 8/2012 | Fassam et al. | 347/20 |
| 2013/0050368 | A1 * | 2/2013 | Lahut et al. | 347/102 |
| 2013/0083129 | A1 * | 4/2013 | Thompson et al. | 347/51 |

FOREIGN PATENT DOCUMENTS

| | | | |
|---|---|---|---|
| JP | 2005-120141 | A | 12/2005 |
| JP | 2009-208228 | A | 9/2009 |
| WO | WO 2008081996 | A2 * | 7/2008 |
| WO | 2010150023 | A2 | 12/2010 |
| WO | 2011021051 | A1 | 2/2011 |
| WO | 2011021052 | A2 | 2/2011 |

OTHER PUBLICATIONS

Sericol Limited (GB 0914652.3), Printing Ink.*
Sericol Limited (GB 0914648.1), Printing Ink.*
Search Report for corresponding application GB1102548.3.
International Search Report for priority application PCT/GB2012/050329 mailed Apr. 24, 2012.

* cited by examiner

INK-JET PRINTING METHOD

FIELD OF THE INVENTION

The present invention relates to a printing ink, and particularly to a method for printing a hybrid inkjet ink.

BACKGROUND OF THE INVENTION

Digital inkjet printing is becoming an increasingly popular method for the production of fine graphic images for advertising, due to its low implementation cost and versatility in comparison with traditional techniques such as lithographic and screen printing. Inkjet printers comprise one or more printheads that include a series of nozzles through which ink is ejected onto a substrate. The printheads are typically provided on a printer carriage that traverses the print width (moves back and forth across the substrate) during the printing process.

Two main ink chemistries are used: inks that dry by solvent evaporation and inks that dry by exposure to actinic radiation (typically UV radiation). Wide-format solvent-based inkjet printers are an economic route into the industry as they are a relatively low-cost option compared to the more complex machines employed for UV curing. Solvent-based inkjet printing also has other advantages. As well as the lower cost, the ink films produced are thinner (and therefore flexible) and yield a good quality natural looking image with a gloss finish. Furthermore, it is difficult to achieve very high pigment loadings in UV curable inks due to the high viscosity of the ink: if too much pigment is added, the ink becomes too viscous and cannot be jetted. In contrast, solvent-based inks include a high proportion of solvent and therefore have a lower viscosity, which means that higher pigment loadings can be tolerated. In addition, the printed film produced from solvent-based inkjet inks is formed predominantly of pigment along with comparatively few other solids that are included in the ink. The pigment is therefore largely unobscured, resulting in intense, vivid and vibrant colours and a large colour gamut.

However, there are some limitations to solvent-based inkjet technology. In particular, solvent-based inks may not adhere to certain types of substrate, particularly non-porous substrates such as plastics, and the cured films have poor resistance to solvents. However, the printing of high-quality low-intercolour-bleed inkjet images with good mechanical and chemical resistance properties onto less receptive substrates is a requirement in many industrial printing applications. Such substrates include rigid PVCs, polyester and polycarbonate.

In addition, inkjet inks capable of being printed at small drop sizes and hence producing the required high image quality have a number of formulation constraints, including the requirement for low viscosity in order to be printed through these low drop volume printheads. This is easily achievable with solvent-based ink compositions due the inherent low viscosity of the organic solvents used. However, these types of ink often have poor chemical and scratch resistance and can have difficulty in drying on these less receptive materials.

To give adequate head stability, solvent-based inkjet inks are typically formulated with relatively low evaporation rate solvents and the inks rely on both evaporation and imbibition into the substrate to give adequate pinning of the ink droplets to fix the image quality (the term "pinning" is used in the art to mean arresting the flow of the ink by treating the ink droplets quickly after they have impacted onto the substrate surface). If the solvent is not able to penetrate into the substrate after deposition of the ink droplet, the rate of viscosity increase is too slow resulting in excessive bleed. If faster evaporating solvents are used in an attempt to overcome this problem head stability can be compromised through solvent loss leading to build up of dried ink deposits on the head face plate. In addition the use of faster solvent blends can also give rise to undesirable Marangoni effects, where faster evaporation at the edge of the ink deposit gives rise to a surface tension gradient which drives a bulk flow to the print edges (the so-called "coffee stain effect").

Conventional UV-curable inkjet inks have excellent head stability and typically have better mechanical and chemical resistance properties than solvent-based inks. Image quality is less affected by the nature of the substrate as the droplet is cured or partially pinned by exposure to ultraviolet light immediately after deposition. However, the inherently higher viscosity of the radiation-curable materials greatly restricts the formulation latitude and in practice inks with suitably low viscosities have poor mechanical and chemical resistance properties.

Hybrid radiation-curable/solvent-containing inkjet inks (see, for example, international patent application no. PCT/GB2010/051384) can overcome most of the above limitations and allow UV-curable inks to be formulated to meet the low viscosity requirements (previously met by purely solvent-based inks) whilst still maintaining the chemical resistance and mechanical properties (as previously provided mainly by UV-curable inks) required for these industrial applications. However, in common with purely solvent-based inks, there are limitations to the substrate types that can be used. This is because, like solvent-based inks, hybrid inks also fix image quality by solvent loss and imbibition; this means that image quality is reduced on non solvent receptive substrates and so presents a problem. Accordingly, there remains a need in the art for approaches which address these problems.

BRIEF SUMMARY OF THE INVENTION

Accordingly, the present invention provides a method of inkjet printing comprising the following steps, in order:

(i) providing a hybrid inkjet ink comprising an organic solvent, a radiation-curable material, a photoinitiator and optionally a colorant;

(ii) printing the ink on to a substrate;

(iii) pinning the ink by exposing the ink to actinic radiation at a dose of 1-200 mJ/cm$^2$;

(iv) evaporating at least a portion of the solvent from the ink; and (v) exposing the ink to additional actinic radiation to cure the ink.

Thus, it has surprisingly been found that it is possible to pin (or partially cure) a hybrid inkjet ink composition by firstly exposing the wet ink film to a weak UV source immediately after deposition without first evaporating the organic solvent in the composition. In this manner the viscosity of the wet ink composition can be increased just sufficiently to arrest the flow of the ink droplet and prevent degradation of the image quality due to ink bleed, thus avoiding the problems highlighted hereinabove. At this stage it is critical that the level of UV exposure is restricted to avoid excessive polymerisation of the film, which will lead to solvent entrapment and degradation of image quality and resistance properties.

After pinning the solvent is then removed by evaporation, for example by exposure to a suitable heat source. Finally the film is fully cured, by exposure to a suitable radiation source. By using this process it is possible to achieve all the key properties required on substrates typically used in these applications.

BRIEF DESCRIPTION OF THE DRAWINGS

The present invention will now be described with reference to the accompanying drawings, in which.

DETAILED DESCRIPTION OF THE INVENTION

The Ink

Figure 1:
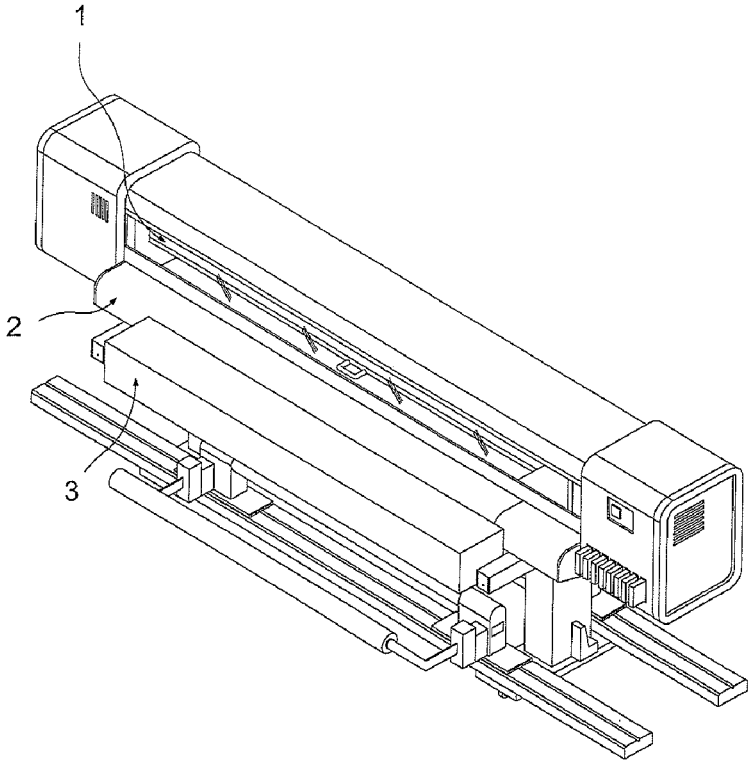
FIG. 1 shows a perspective view of an exemplary embodiment of an inkjet printing apparatus according to the present invention.

The inks of the present invention comprise a modified ink binder system. The presence of a radiation-curable material and a photoinitiator in the ink means that crosslinked polymers can be formed in the dried ink film, leading to improved adhesion to a range of substrates and improved resistance to solvents. The presence of at least 30% by weight of organic solvent means that the advantageous properties of solvent-based inkjet inks are expected to be maintained, however.

By "radiation-curable material" is meant a material that polymerises or crosslinks when exposed to radiation, commonly ultraviolet light, in the presence of a photoinitiator.

The radiation-curable material can comprise a monomer with a molecular weight of 450 or less, an oligomer, or mixtures thereof. The monomers and/or oligomers may possess different degrees of functionality, and a mixture including combinations of mono, di, tri and higher functionality monomers and/or oligomers may be used.

Preferably, the radiation-curable material comprises a radiation-curable oligomer.

Radiation-curable oligomers suitable for use in the present invention comprise a backbone, for example a polyester, urethane, epoxy or polyether backbone, and one or more radiation polymerisable groups. The polymerisable group can be any group that is capable of polymerising upon exposure to radiation.

Preferred oligomers have a molecular weight of 500 to 4,000, more preferably 600 to 4,000. Molecular weights (number average) can be calculated if the structure of the oligomer is known or molecular weights can be measured using gel permeation chromatography using polystyrene standards.

In one embodiment the radiation-curable material polymerises by free-radical polymerisation.

Suitable free-radical polymerisable monomers are well known in the art and include (meth)acrylates, α,β-unsaturated ethers, vinyl amides and mixtures thereof.

Monofunctional (meth)acrylate monomers are well known in the art and are preferably the esters of acrylic acid. Preferred examples include phenoxyethyl acrylate (PEA), cyclic TMP formal acrylate (CTFA), isobornyl acrylate (IBOA), tetrahydrofurfuryl acrylate (THFA), 2-(2-ethoxyethoxy)ethyl acrylate, octadecyl acrylate (ODA), tridecyl acrylate (TDA), isodecyl acrylate (IDA) and lauryl acrylate. PEA is particularly preferred.

Suitable multifunctional (meth)acrylate monomers include di-, tri- and tetra-functional monomers. Examples of the multifunctional acrylate monomers that may be included in the ink-jet inks include hexanediol diacrylate, trimethylolpropane triacrylate, pentaerythritol triacrylate, polyethylene glycol diacrylate (for example tetraethylene glycol diacrylate), dipropylene glycol diacrylate, tri(propylene glycol) triacrylate, neopentyl glycol diacrylate, bis(pentaerythritol) hexaacrylate, and the acrylate esters of ethoxylated or propoxylated glycols and polyols, for example, propoxylated neopentyl glycol diacrylate, ethoxylated trimethylolpropane triacrylate, and mixtures thereof.

Suitable multifunctional (meth)acrylate monomers also include esters of methacrylic acid (i.e. methacrylates), such as hexanediol dimethacrylate, trimethylolpropane trimethacrylate, triethyleneglycol dimethacrylate, diethyleneglycol dimethacrylate, ethyleneglycol dimethacrylate, 1,4-butanediol dimethacrylate. Mixtures of (meth)acrylates may also be used. (Meth)acrylate is intended herein to have its standard meaning, i.e. acrylate and/or methacrylate. Mono and multifunctional are also intended to have their standard meanings, i.e. one and two or more groups, respectively, which take part in the polymerisation reaction on curing.

α,β-Unsaturated ether monomers can polymerise by free-radical polymerisation and may be useful for reducing the viscosity of the ink when used in combination with one or more (meth)acrylate monomers. Examples are well known in the art and include vinyl ethers such as triethylene glycol divinyl ether, diethylene glycol divinyl ether, 1,4-cyclohexanedimethanol divinyl ether and ethylene glycol monovinyl ether. Mixtures of α,β-unsaturated ether monomers may be used.

N-Vinyl amides and N-(meth)acryloyl amines may also be used in the inks of the invention. N-vinyl amides are well-known monomers in the art and a detailed description is therefore not required. N-vinyl amides have a vinyl group attached to the nitrogen atom of an amide which may be further substituted in an analogous manner to the (meth) acrylate monomers. Preferred examples are N-vinyl caprolactam (NVC) and N-vinyl pyrrolidone (NVP). Similarly, N-acryloyl amines are also well-known in the art. N-acryloyl amines also have a vinyl group attached to an amide but via the carbonyl carbon atom and again may be further substituted in an analogous manner to the (meth)acrylate monomers. A preferred example is N-acryloylmorpholine (ACMO).

Particularly preferred radiation-curable materials are oligomers with free-radical polymerisable groups, preferably (meth)acrylate groups. Acrylate functional oligomers are most preferred.

In one embodiment the oligomer comprises two or more radical polymerisable groups, preferably three or more, more preferably four or more. Oligomers comprising six polymerisable groups are particularly preferred.

The oligomer preferably comprises a urethane backbone.

Particularly preferred radiation-curable materials are urethane acrylate oligomers as these have excellent adhesion and elongation properties. Most preferred are tri-, tetra-, penta-, hexa- or higher functional urethane acrylates, particularly hexafunctional urethane acrylates as these yield films with good solvent resistance.

Other suitable examples of radiation-curable oligomers include epoxy based materials such as bisphenol A epoxy acrylates and epoxy novolac acrylates, which have fast cure speeds and provide cured films with good solvent resistance.

The radiation-curable oligomer used in the preferred inks of the invention cures upon exposure to radiation in the presence of a photoinitiator to form a crosslinked, solid film. The resulting film has good adhesion to substrates and good solvent resistance. Any radiation-curable oligomer that is compatible with the remaining ink components and that is capable of curing to form a crosslinked, solid film is suitable for use in the ink of the present invention. Thus, the ink formulator is able to select from a wide range of suitable oligomers. In particular, the oligomer can be a low molecular weight material that is in liquid form at 25° C. This is beneficial when aiming to produce a low viscosity ink. Furthermore, the use of a low molecular weight, liquid oligomer is advantageous when formulating the ink because low molecular weight liquid oligomers are likely to be miscible in a wide range of solvents.

Preferred oligomers for use in the invention have a viscosity of 0.5 to 20 Pa·s at 60° C., more preferably 5 to 15 Pa·s at 60° C. and most preferably 5 to 10 Pa·s at 60° C. Oligomer viscosities can be measured using an ARG2 rheometer manufactured by T.A. Instruments, which uses a 40 mm oblique/2° steel cone at 60° C. with a shear rate of 25 $seconds^{-1}$.

In one embodiment the radiation-curable material comprises 50 to 100%, or 75 to 100% by weight of free-radical curable oligomer and 0 to 50%, or 0 to 25% by weight of free-radical curable monomer, based on the total weight of radiation-curable material present in the ink.

Preferably the ink comprises less than 20% by weight of radiation-curable material (e.g. (meth)acrylates) having a molecular weight of less than 450 based on the total weight of the ink, or less than 10% by weight, more preferably less than 5% by weight. In a particularly preferred embodiment, the ink of the invention is substantially free of radiation-curable material with a molecular weight of less than 450.

In one embodiment the ink comprises less than 20% by weight of (meth)acrylates with a molecular weight of less than 600 based on the total weight of the ink, or less than 10% by weight, more preferably less than 5% by weight. In a particularly preferred embodiment, the ink of the invention is substantially free of (meth)acrylates with a molecular weight of less than 600.

By "substantially free" is meant that no radiation-curable material having a molecular weight of less than 450 or 600, respectively, is intentionally added to the ink. However, minor amounts may be present as impurities in commercially available radiation-curable oligomers or in the pigment dispersion and are tolerated.

In an alternative embodiment of the invention the radiation-curable material is capable of polymerising by cationic polymerisation. Suitable materials include, oxetanes, cycloaliphatic epoxides, bisphenol A epoxides, epoxy novolacs and the like. The radiation-curable material according to this embodiment may comprise a mixture of cationically curable monomer and oligomer. For example, the radiation-curable material may comprise a mixture of an epoxide oligomer and an oxetane monomer.

In one embodiment the radiation-curable material comprises 0 to 40% by weight of cationically curable oligomer and 60 to 100% by weight of cationically curable monomer based on the total weight of radiation-curable material present in the ink.

The radiation-curable material can also comprise a combination of free-radical polymerisable and cationically polymerisable materials.

The radiation-curable material is preferably present in the composition in an amount of 2% to 65% by weight, based on the total weight of the ink, more preferably 2 to 45% by weight, more preferably 5 to 35% by weight, more preferably 8 to 25% by weight, and most preferably 10% to 25% by weight.

The ink of the invention includes one or more photoinitiators. When the ink of the invention includes a free-radical polymerisable material the photoinitiator system includes a free-radical photoinitiator and when the ink includes a cationic polymerisable material the photoinitiator system includes a cationic photoinitiator. When the ink comprises a combination of free-radical polymerisable and cationically polymerisable materials both a free-radical and cationic initiator are required.

The free-radical photoinitiator can be selected from any of those known in the art. For example, benzophenone, 1-hydroxycyclohexyl phenyl ketone, 1-[4-(2-hydroxyethoxy)-phenyl]-2-hydroxy-2-methyl-1-propane-1-one, 2-benzyl-2-dimethylamino-(4-morpholinophenyl)butan-1-one, isopropyl thioxanthone, benzil dimethylketal, bis(2,6-dimethylbenzoyl)-2,4,4-trimethylpentylphosphine oxide or mixtures thereof. Such photoinitiators are known and commercially available such as, for example, under the trade names Irgacure and Darocur (from Ciba) and Lucerin (from BASF).

In the case of a cationically curable system, any suitable cationic initiator can be used, for example sulfonium or iodonium based systems. Non limiting examples include: Rhodorsil PI 2074 from Rhodia; MC AA, MC BB, MC CC, MC CC PF, MC SD from Siber Hegner; UV9380c from Alfa Chemicals; Uvacure 1590 from UCB Chemicals; and Esacure 1064 from Lamberti spa.

Preferably the photoinitiator is present in an amount of 1 to 20% by weight, preferably 4 to 10% by weight, based on the total weight of the ink.

The ink of the invention contains an organic solvent. The organic solvent is in the form of a liquid at ambient temperatures and is capable of acting as a carrier for the remaining components of the ink. The organic solvent component of the ink of the invention may be a single solvent or a mixture of two or more solvents. As with known solvent-based inkjet inks, the organic solvent used in the ink of the present invention is required to evaporate from the printed ink, typically on heating, in order to allow the ink to dry. The solvent can be selected from any solvent commonly used in the printing industry, such as glycol ethers, glycol ether esters, alcohols, ketones, esters and pyrrolidones.

The organic solvent is preferably present in an amount of at least 30% by weight, more preferably at least 50% by weight, and most preferably at least 60% by weight based on the total weight of the ink. The upper limit is typically 85% or 75% by weight based on the total weight of the ink.

Known solvent-based inkjet inks dry solely by solvent evaporation with no crosslinking or polymerisation occurring. The film produced therefore has limited chemical resistance properties. In order to improve resistance of prints to common solvents such as alcohols and petrol, binder materials that have limited solubility in these solvents are added to the ink. The binder is typically in solid form at 25° C. so that a solid printed film is produced when solvent is evaporated from the ink. Suitable binders such as vinyl chloride copolymer resins generally have poor solubility in all but the strongest of solvents such as glycol ether acetates and cyclohexanone, both of which are classified as "harmful" and have strong odours. In order to solubilise the binder, these solvents are generally added to the ink.

The ink of the present invention includes radiation-curable material that cures as the ink dries and it is not therefore necessary to include a binder in the ink in order to provide a printed film having improved solvent resistance. In one embodiment of the invention the organic solvent is not therefore required to solubilise a binder such as a vinyl chloride copolymer resin, which means that the ink formulator has more freedom when selecting a suitable solvent or solvent mixture.

In a preferred embodiment the organic solvent is a low toxicity and/or a low odour solvent. Solvents that have been given VOC exempt status by the United States Environmental Protection Agency or European Council are also preferred.

The most preferred solvents are selected from glycol ethers and organic carbonates and mixtures thereof. Cyclic carbonates such as propylene carbonate and mixtures of propylene carbonate and one or more glycol ethers are particularly preferred.

Alternative preferred solvents include lactones, which have been found to improve adhesion of the ink to PVC substrates. Mixtures of lactones and one or more glycol ethers, and mixtures of lactones, one or more glycol ethers and one or more organic carbonates are particularly preferred. Mixtures of gamma butyrolactone and one or more glycol ethers, and mixtures of gamma butyrolactone, one or more glycol ethers and propylene carbonate are particularly preferred.

In another embodiment of the invention, dibasic esters and/or bio-solvents may be used.

Dibasic esters are known solvents in the art. They can be described as di($C_1$-$C_4$ alkyl) esters of a saturated aliphatic dicarboxylic acid having 3 to 8 carbon atoms having following general formula:

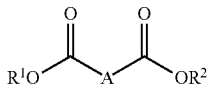

in which A represents $(CH_2)_{1-6}$, and $R^1$ and $R^2$ may be the same or different and represent $C_1$-$C_4$ alkyl which may be a linear or branched alkyl radical having 1 to 4 carbon atoms, preferably methyl or ethyl, and most preferably methyl. Mixtures of dibasic esters can be used.

Bio-solvents, or solvent replacements from biological sources, have the potential to reduce dramatically the amount of environmentally-polluting VOCs released in to the atmosphere and have the further advantage that they are sustainable. Moreover, new methods of production of bio-solvents derived from biological feedstocks are being discovered, which allow bio-solvent production at lower cost and higher purity.

Examples of bio-solvents include soy methyl ester, lactate esters, polyhydroxyalkanoates, terpenes and non-linear alcohols, and D-limonene. Soy methyl ester is prepared from soy. The fatty acid ester is produced by esterification of soy oil with methanol. Lactate esters preferably use fermentation-derived lactic acid which is reacted with methanol and/or ethanol to produce the ester. An example is ethyl lactate which is derived from corn (a renewable source) and is approved by the FDA for use as a food additive. Polyhydroxyalkanoates are linear polyesters which are derived from fermentation of sugars or lipids. Terpenes and non linear alcohol may be derived from corn cobs/rice hulls. An example is D-limonene which may be extracted from citrus rinds.

Other solvents may be included in the organic solvent component. A particularly common source of other solvents is derived from the way in which the colouring agent is introduced into the inkjet ink formulation. The colouring agent is usually prepared in the form of a pigment dispersion in a solvent, e.g. 2-ethylhexyl acetate. The solvent tends to be around 40 to 50% by weight of the pigment dispersion based on the total weight of the pigment dispersion and the pigment dispersion typically makes up around 5 to 15% by weight of the ink and sometimes more.

The ink is preferably substantially free of water, although some water will typically be absorbed by the ink from the air or be present as impurities in the components of the inks, and such levels are tolerated. For example, the ink may comprise less than 5% by weight of water, more preferably less than 2% by weight of water and most preferably less than 1% by weight of water, based on the total weight of the ink.

The ink of the present invention can be a coloured ink or a colourless ink.

By "colourless" is meant that the ink is substantially free of colorant such that no colour can be detected by the naked eye. Minor amounts of colorant that do not produce colour that can be detected by the eye can be tolerated, however. Typically the amount of colorant present will be less than 0.3% by weight based on the total weight of the ink, preferably less than 0.1%, more preferably less than 0.03%. Colourless inks may also be described as "clear" or "water white".

Coloured inks of the invention comprise at least one colouring agent. The colouring agent may be either dissolved or dispersed in the liquid medium of the ink. Preferably the colouring agent is a dispersible pigment, of the types known in the art and commercially available such as under the trade-names Paliotol (available from BASF plc), Cinquasia, Irgalite (both available from Ciba Speciality Chemicals) and Hostaperm (available from Clariant UK). The pigment may be of any desired colour such as, for example, Pigment Yellow 13, Pigment Yellow 83, Pigment Red 9, Pigment Red 184, Pigment Blue 15:3, Pigment Green 7, Pigment Violet 19, Pigment Black 7. Especially useful are black and the colours required for trichromatic process printing. Mixtures of pigments may be used.

In one aspect of the invention the following pigments are preferred. Cyan: phthalocyanine pigments such as Phthalocyanine blue 15.4. Yellow: azo pigments such as Pigment yellow 120, Pigment yellow 151 and Pigment yellow 155. Magenta: quinacridone pigments, such as Pigment violet 19 or mixed crystal quinacridones such as Cromophtal Jet magenta 2BC and Cinquasia RT-355D. Black: carbon black pigments such as Pigment black 7.

Pigment particles dispersed in the ink should be sufficiently small to allow the ink to pass through an inkjet nozzle, typically having a particle size less than 8 μm, preferably less than 5 μm, more preferably less than 1 μm and particularly preferably less than 0.5 μm.

The colorant is preferably present in an amount of 20 weight % or less, preferably 10 weight % or less, more preferably 8 weight % or less and most preferably 2 to 5% by weight, based on the total weight of the ink. A higher concentration of pigment may be required for white inks, however, for example up to and including 30 weight %, or 25 weight % based on the total weight of the ink.

The ink can optionally contain a thermoplastic resin. The thermoplastic resin does not include reactive groups that are able to crosslink on exposure to radiation. In other words, thermoplastic resin is not a radiation-curable material. Suitable materials have molecular weights ranging from 10,000 to 100,000 as determined by GPC with polystyrene standards. The thermoplastic resin can be selected from epoxy, polyester, vinyl or (meth)acrylate resins, for example. Methacrylate copolymers are preferred. When present, the ink can comprise 1 to 5% by weight of thermoplastic resin, based on the total weight of the ink. The thermoplastic resin increases the viscosity of the ink film prior to curing, leading to improved print definition. The thermoplastic resin also decreases the glass transition temperature of the cured ink, giving greater film flexibility for applications such as vehicle side application.

In one embodiment, the ink of the invention comprises at least 50% by weight of organic solvent based on the total weight of the ink; a radiation-curable material, wherein the radiation-curable material comprises 50 to 100% by weight of free-radical curable oligomer having a molecular weight of 600 to 4,000 and 0 to 50% by weight of free-radical curable monomer having a molecular weight of 450 or less based on the total weight of radiation-curable material present in the ink; a free-radical photoinitiator; and optionally a colorant.

The inkjet ink exhibits a desirable low viscosity (200 mPa·s or less, preferably 100 mPa·s or less, more preferably 25 mPa·s or less, more preferably 10 mPa·s or less and most preferably 7 mPa·s or less at 25° C.).

In order to produce a high quality printed image a small jetted drop size is desirable. Furthermore, small droplets have a higher surface area to volume ratio when compared to larger drop sizes, which facilitates evaporation of solvent from the jetted ink. Small drop sizes therefore offer advantages in drying speed. Preferably the inkjet ink of the invention is jetted at drop sizes below 50 picoliters, preferably below 30 picoliters and most preferably below 10 picoliters.

To achieve compatibility with print heads that are capable of jetting drop sizes of 50 picoliters or less, a low viscosity ink is required. A viscosity of 10 mPa·s or less at 25° C. is preferred, for example, 2 to 10 mPas, 4 to 8 mPa·s, or 5 to 7 mPa·s. It is problematic to achieve these low viscosities with conventional radiation-curable inks due to the relatively high viscosities of acrylate monomers and oligomers used in the compositions, but the presence of a significant amount of organic solvent in the ink of the invention allows these low viscosities to be achieved.

Ink viscosity may be measured using a Brookfield viscometer fitted with a thermostatically controlled cup and spindle arrangement, such as a DV1 low-viscosity viscometer running at 20 rpm at 25° C. with spindle 00.

Other components of types known in the art may be present in the ink to improve the properties or performance. These components may be, for example, surfactants, defoamers, dispersants, synergists for the photoinitiator, stabilisers against deterioration by heat or light, reodorants, flow or slip aids, biocides and identifying tracers.

In one aspect of the invention the surface tension of the ink is controlled by the addition of one or more surface active materials such as commercially available surfactants. Adjustment of the surface tension of the ink allows control of the surface wetting of the ink on various substrates, for example, plastic substrates. Too high a surface tension can lead to ink pooling and/or a mottled appearance in high coverage areas of the print. Too low a surface tension can lead to excessive ink bleed between different coloured inks. The surface tension is preferably in the range of 20-32 $mNm^{-1}$ and more preferably 21-27 $mNm^{-1}$.

The present invention also provides an ink set comprising a cyan ink, a magenta ink, a yellow ink and a black ink (a so-called trichromatic set), wherein at least one of the inks is an ink according to the present invention. Preferably all of the inks in the ink set are inks according to the present invention. The inks in a trichromatic set can be used to produce a wide range of secondary colours and tones by overlaying the printed dots on white substrate.

The ink set of the present invention can optionally include one or more light colour inks. Light colour versions of any colour ink can be used but preferred colours are light cyan, light magenta and light black. Particularly preferred are light cyan inks and light magenta inks. Light colour inks serve to extend the colour gamut and smooth the gradation from highlight to shadow areas of the printed image.

The ink set of the present invention can optionally include one or more of a green ink, an orange ink and a violet ink. These colours further extend the gamut of colours that can be produced. Violet and orange inks are preferred, most preferred is orange ink.

The ink set of the present invention can optionally include a white ink. White ink can be used in two ways. When printing onto a transparent substrate, white ink can be printed over the image such that the image can be viewed from the reverse. Alternatively, white ink can be used to print a base coat onto a coloured substrate before the image is printed.

Even with the range of inks detailed above, some colours can be particularly difficult to produce. Where it is essential that a printed colour is an exact match to a standard, such as a corporate colour, the ink set of the invention can optionally contain one or more inks having matched spot colours, which are designed to be printed in pure form with no overlaying.

The ink of the present invention can produce an image having a high gloss finish. This means that when the ink is printed on a substrate having low gloss, areas of the image that have high deposits of ink (for example where the image has deep colour or dark shading) have a significantly higher gloss level than areas of the image that have low deposits of ink (for example, where there is only light shading in the image). In other words, highlight areas of the print will have a lower gloss level than the shadow areas. Sharp lines can appear in the image where the transitions from heavy to light shading (e.g. from heavy gloss to low gloss) occur, which can lead to unattractive prints.

In order to provide an even finish and therefore improve the image quality, the entire print can optionally be coated with a colourless ink or varnish. Preferably, however, the ink of the invention is printed together with a colourless ink. The ink set of the present invention therefore preferably includes a colourless ink.

The colourless ink is jetted at the same time as the coloured ink of the invention but the colourless ink is deposited in blank or highlight areas of the image that do not have high deposits of coloured ink. This means that the ink film covers the entire printed surface of the substrate, which results in prints with a more even finish across the print. The prints can also tend to have a more even ink film weight across the film, which improves the appearance of the prints because the surface topography is more even and the transitions between the areas of heavy coloured ink deposits to highlights are smoother.

Print heads account for a significant portion of the cost of an entry level printer and it is therefore desirable to keep the number of print heads (and therefore the number of inks in the ink set) low. Reducing the number of print heads can reduce print quality and productivity, however. It is therefore desirable to balance the number of print heads in order to minimise cost without compromising print quality and productivity. One preferred ink set of the present invention comprises a cyan ink, a yellow ink, a magenta ink and a black ink. This limited combination of colours can achieve prints with a very high gloss that is even across the print, very good graduations of tone and a high colour gamut. Further variations of the above ink set can include the above ink set plus either one or more of a clear varnish, a metallic and a white ink. Another example of ink set is a cyan ink, a yellow ink, a magenta ink and a black ink, a colourless ink, a light cyan ink, a light magenta ink and an orange ink.

When the ink of the present invention is provided in an ink set, the surface tensions of the different inks in the ink set preferably differ by no more than 2 $mNm^{-1}$, more preferably no more than 1 $mNm^{-1}$ and most preferably no more than 0.5 $mNm^{-1}$. Carefully balancing the surface tension of the different inks in this manner can lead to improvements in the quality and appearance of the printed image.

The ink set of the invention can optionally include one or more metallic effect inks. The use of metallic colours such as silver is becoming increasing popular in advertising images, for example.

Conventional solvent-based metallic inks can produce very bright metallic effects. The metallic pigments are in the form of flakes or platelets and these are randomly orientated in the undried liquid ink. In the case of solvent-containing inks, the flakes can align parallel to the print surface as the ink film thickness reduces as a result of solvent loss in the drying process. The alignment of metallic pigment flakes parallel with the print surface results in good reflectivity and metallic lustre. However, the films produced can often have very poor rub properties, which means that the pigment can be easily removed from the print surface. UV cured metallic inks generally have better rub properties but are often dull in appearance because the metallic pigment flakes do not have time to align during the rapid UV curing process.

Metallic inks of the present invention overcome these problems because the inks dry in two stages, as discussed below. During the solvent evaporation step the metallic flakes have time to align, allowing a bright metallic effect to be produced in the final image. However, the UV curing stage yields a rub-resistant film.

Colourless inks according to the present invention may be used as a varnish. In one embodiment of the invention the colourless ink may be used as a varnish for a conventional solvent-based metallic effect ink. Metallic effect prints can be protected with known UV curable varnishes but the high film weight produced when these materials are jetted dulls the metallic lustre of the prints and is deleterious to their appearance. The presence of a relatively large proportion of volatile solvent in the colourless inks of the present invention allows a low film weight to be deposited, however. Typically a UV varnish would produce a 12 μm film over the surface of the print. By using a colourless ink according to the present invention, the film weight can be reduced to 2 to 3 μm. The low film weight of the hybrid varnish has a far less deleterious affect on the appearance of the metallic print.

The inks of the present invention are primarily designed for printing onto flexible substrates but the nature of the substrate is not limited and includes any substrate which may be subjected to inkjet printing such as glass, metals, plastics and paper. Most preferred are flexible substrates, especially flexible substrates used for the graphic printing industry. Non limiting examples include, polyesters, fabric meshes, vinyl substrates, paper and the like. The inks of the present invention are particularly suited for printing onto self adhesive vinyl and banner grade PVC substrates.

The ink may be prepared by known methods such as stirring with a high-speed water-cooled stirrer, or milling on a horizontal bead-mill.

The Printing Method

The printing method of the present invention requires the initial pinning of the inkjet ink by exposing the ink to a low dose of actinic radiation. This provides a partial cure of the ink and thereby maximises image quality by controlling bleed and feathering between image areas. The ink is then dried by the evaporation of the solvent in order to provide a high-viscosity coating which is capable of undergoing further curing. The coating is then exposed to further actinic radiation to cure the ink fully.

It should be noted that the terms "dry" and "cure" are often used interchangeably in the art when referring to radiation-curable inkjet inks to mean the conversion of the inkjet ink from a liquid to solid by polymerisation and/or crosslinking of the radiation-curable material. Herein, however, by "drying" is meant the removal of the solvent by evaporation and by "curing" is meant the polymerisation and/or crosslinking of the radiation-curable material. With the hybrid inks and method of the present invention, pinning and drying leads to a marked increase in viscosity, whereas the final cure converts the inkjet ink from a liquid ink to a solid film.

FIG. 1 shows a perspective view of an exemplary embodiment of an inkjet printing apparatus for use in the method according to the present invention. The apparatus includes a printer head (1), a heating unit (2) and a UV curing unit (3).

Figure 2:
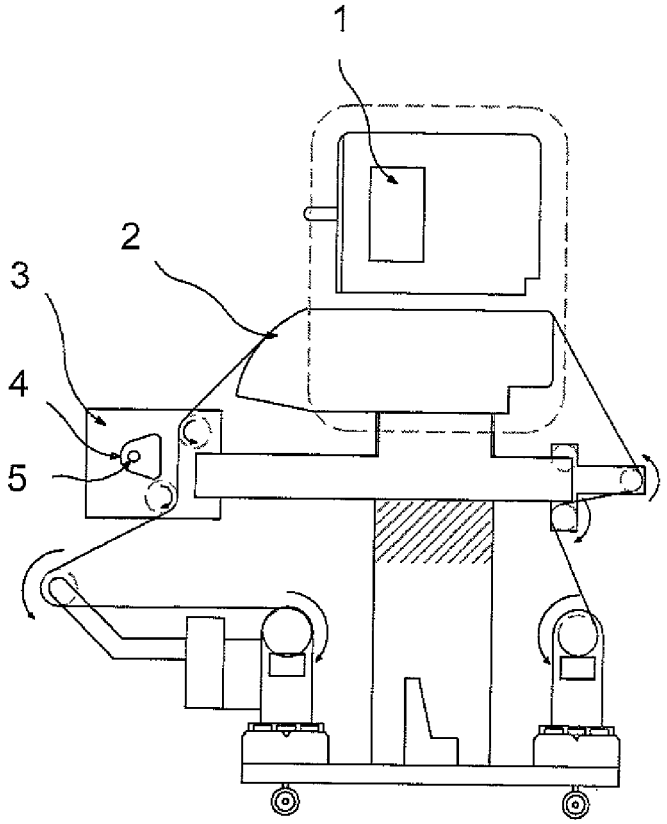
FIG. 2 shows a section view of an exemplary embodiment of an inkjet printing apparatus (roll-to-roll printer) according to the present invention.

FIG. 2 shows a section view of an exemplary embodiment of an inkjet printing apparatus for use in the method according to the present invention. The printer is a roll-to-roll printer. The apparatus includes a print carriage including a print head (1), heating unit(s) (2), a UV curing unit (3) comprising a reflector (4) and a bulb (5).

Figure 3:
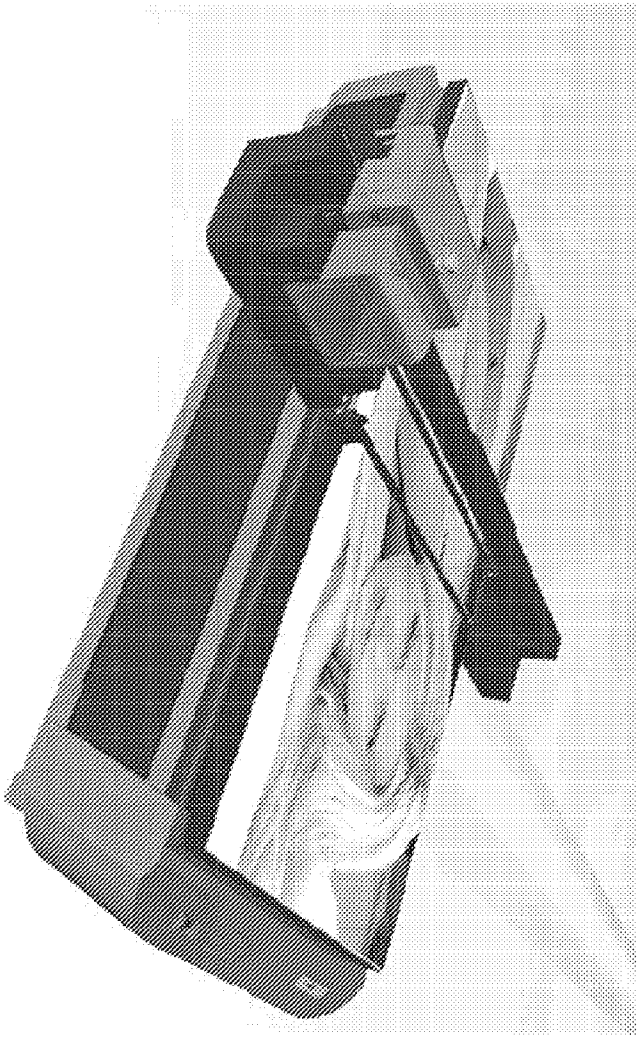
FIG. 3 shows a section view of an exemplary embodiment of an inkjet printing apparatus (flat-bed printer) according to the present invention.

FIG. 3 shows a photograph of a flat-bed printer which also falls within the scope of the present invention.

With conventional solvent-based inks, the printer productivity is governed by the system's ability to expel the bulk solvent. If too much wet ink is laid down on the medium, the ink flows to blur the printed image. For this reason, solvents with a high vapour pressure are preferred in the ink. However, if the solvent vapour pressure is too high, ink drying on the printhead nozzle plate may lead to blocked nozzles. This compromise in solvent selection leads to a limitation in productivity.

Because of their lower productivity, the capital cost for solvent printers has to be relatively low to remain commercially viable. The internal mechanisms are therefore kept simple, with as few printheads as possible to produce a reasonable quality image. The low complexity makes these machines easy to operate and maintain.

Over recent years, UV curable ink systems have largely replaced solvent ink printers in the higher productivity range, wide format graphics market. Unlike solvent printers, the ink deposited on the surface does not appreciably evaporate upon heating. Instead, the material is transformed into a solid through exposure to an energy source. In most cases, the energy source is an intense UV light, which causes photo-crosslinking of curable molecules in the presence of a photoinitiator to form a solid.

The greatest perceived benefit of UV curable printers is their ability to deliver high production rates. In most UV printers, the cure source is mounted on the shuttling printhead carriage, on one or both sides of the printhead cluster. In some cases, cure systems are also placed between printheads. With a typical separation distance of less than 100 mm between the print heads and cure unit, the maximum time between print and cure would be 0.1 s for a printhead carriage moving at 1 m/s. UV ink solidification times of less than one second compare favourably with solvent inks that can take several minutes to dry. Inkjet printers for UV curable inks are necessarily more complex and consequently more expensive than inkjet inks printers for solvent-based inks, however.

The ink of the present invention can be printed using inkjet printers that are suitable for use with solvent-based inkjet inks, in combination with a source of actinic radiation.

The features of printers that are suitable for printing solvent-based inkjet inks are well known to the person skilled in the art and include the features described below.

As discussed above, printers suitable for printing solvent-based inkjet inks typically have a low capital cost, which means that the printers tend to have simple internal mechanisms. In practice, this means that inkjet printers suitable for printing solvent-based inks typically comprise gravity feed systems for delivering ink from the ink supply to the printhead. In contrast, UV printers use a pressurised header tank for delivering the ink to the printhead, which allows control of the meniscus position in the nozzle.

Since printheads account for a large proportion of the overall printer cost, inkjet printers suitable for printing solvent-based inkjet inks include the minimum number of printheads that is required to provide a high quality image. In any event, because solvent-based inkjet inks typically require longer to dry than UV inks, there is less advantage in using many printheads to apply large quantities of ink to the substrate because this causes the ink to pool and the image to blur.

Furthermore, printheads that are for printing solvent-based inkjet inks are not provided with a means for heating the ink because solvent-based inks have a low viscosity and do not therefore require heating at the printhead to produce a jettable viscosity (in contrast with UV curable inks). Thus, known solvent-based inks are jetted at ambient temperatures.

Solvent-based inkjet inks are susceptible to drying on the nozzle plate due to evaporation of the solvent. Printers for solvent-based inkjet inks therefore typically include suction cups which can be used to cap the printheads when not in use, allowing a solvent vapour saturated environment to be established, which limits evaporation. Should a printhead become blocked, the suction cup can be used to pull a small volume of ink through the blockage, using a peristaltic pump, to recover performance after excess ink is removed using a wiper blade.

The ink of the present invention comprises both a solvent and a radiation-curable component and therefore dries by a combination of evaporation of the organic solvent and curing of the radiation-curable component upon exposure to actinic radiation.

The ink of the present invention can surprisingly be used in printers that are suitable for printing conventional solvent-based inkjet inks, provided that a source of actinic radiation is also provided. Typically the printheads of inkjet printers for solvent-based inks are not externally heated. The inks of the present invention can be jetted at ambient temperature, preferably below 35° C., or below 30° C. or about 25° C., and are therefore compatible with the printheads and nozzles that are used to print solvent-based inkjet inks. The use of a printer that is for printing conventional solvent-based inkjet inks, particularly printheads, nozzles and ink delivery systems that are for use with conventional solvent-based inkjet inks, as the basis of the printing apparatus of the invention means that printing apparatus of the invention has a low capital cost.

A printer that is suitable for printing a conventional solvent-based inkjet ink may be adapted before use in printing the inks of the present invention. Depending on the exact nature of the ink and the location of the cure source, opaque ink feed components that are chemically compatible with the ink may be used and/or a UV screen filter film may be applied to the print window on the front of the apparatus. These are minor adaptations that would not have a significant effect on printer cost or performance.

In one embodiment, the printing apparatus of the present invention comprises one or more piezo drop on demand printheads. Preferably the printheads are capable of jetting ink in drop sizes of 50 picoliters or less, more preferably 30 picoliters or less, particularly preferably 10 picoliters or less.

The printing apparatus of the present invention comprises means for evaporating solvent from the ink at the appropriate time after the ink has been applied to the substrate. Any means that is suitable for evaporating solvent from known solvent-based inkjet inks can be used in the apparatus of the invention. Examples are well known to the person skilled in the art and include dryers, heaters, air knives and combinations thereof.

In one embodiment, the solvent is removed by heating. Heat may be applied through the substrate and/or from above the substrate, for example by the use of heated plates (resistive heaters, inductive heaters) provided under the substrate or radiant heaters (heater bars, IR lamps, solid state IR) provided above the substrate. In a preferred embodiment, the ink can be jetted onto a preheated substrate that then moves over a heated platen. The apparatus of the invention may comprise one or more heaters.

When printing the ink of the present invention, a significant portion of the solvent is preferably allowed to evaporate before the ink is cured. Preferably substantially all of the solvent is evaporated before the ink is finally cured. This is achieved by subjecting the printed ink to conditions that would typically dry conventional solvent-based inkjet inks. In the case of the ink of the present invention, such conditions will remove most of the solvent but it is expected that trace amounts of solvent will remain in the film given the presence of the radiation-curable component in the ink.

The solvent evaporation step is thought to be important because it is believed to provide further definition to the image quality. Thus, it is thought that the solvent evaporation step results in a printed image with high gloss, as would be expected for conventional solvent-based inks. Furthermore, the loss of a significant portion of the ink through the evaporation of the solvent leads to the formation of a printed film that is thinner than the film that would be produced by jetting an equivalent volume of known radiation-curable ink. This is advantageous because thinner films have improved flexibility.

Unlike standard solvent-based inks, once the solvent has evaporated, the ink is not expected to be completely solid. Rather, what remains on the surface is a high viscosity version of a radiation-curable ink. The viscosity is sufficiently high to inhibit or significantly hinder ink flow and prevent image degradation in the timescale that is needed to post-cure the ink. Upon exposure to a radiation source, the ink cures to form a relatively thin polymerised film. The ink of the present invention typically produces a printed film having a thickness of 1 to 20 μm, preferably 1 to 10 μm, for example 2 to 5 μm. Film thicknesses can be measured using a confocal laser scanning microscope.

The source of actinic radiation can be any source of actinic radiation that is suitable for curing radiation-curable inks but is preferably a UV source. Suitable UV sources include mercury discharge lamps, fluorescent tubes, light emitting diodes (LEDs), flash lamps and combinations thereof. One or more mercury discharge lamps, fluorescent tubes, or flash lamps may be used as the radiation source. When LEDs are used, these are preferably provided as an array of multiple LEDs.

Preferably the source of actinic radiation is a source that does not generate ozone when in use.

The source of actinic radiation for the initial pinning of the ink may be the same or different to the source of actinic radiation for performing the final cure of the ink.

The source of UV radiation could be situated off-line in a dedicated conveyor UV curing unit, such as the SUVD Svecia UV Dryer. Preferably, however, the source of radiation is situated in-line, which means that the substrate does not have to be removed from the printing apparatus between the heating and curing steps.

The radiation source can be mobile, which means that the source is capable of moving back and forth across the print width, parallel with the movement of the printhead.

In one embodiment, one or more sources of actinic radiation are placed on a carriage that allows the source of actinic radiation to traverse the print width. The carriage may be placed up and downstream of the printer carriage in allow irradiation before and after evaporation of the solvent. In this embodiment the source of actinic radiation moves independently of the printer carriage and movement of the printhead does not therefore have to be slowed in order to provide adequate time for solvent evaporation. Thus, overall productivity can be improved.

When the source of radiation is provided on separate carriage, it is necessary to provide an additional carriage rail, motor and control systems. This adaptation can lead to large increases in equipment costs.

Preferably the source of radiation is static. This means that the source does not move backwards and forwards across the print width of the substrate when in use. Instead the source of actinic radiation is fixed and the substrate moves relative to the source in the print direction.

When the source of actinic radiation is provided in the print zone of the printer, light contamination at the printhead, which could lead to premature curing in the nozzle, must be avoided. Adaptations to prevent light contamination, such as lamp shutters, give rise to additional costs. The source of radiation is therefore preferably located outside the print zone of the printing apparatus. By print zone is meant the region of the printing apparatus in which the printhead can move and therefore the region in which ink is applied to the substrate.

A preferred printing apparatus according to the present invention that comprises a static source of radiation located outside the print zone is expected to be economically attractive and therefore suitable for entry level wide format digital graphics use. This embodiment is therefore particularly preferred. By entry level is meant the simplest and cheapest printers that are suitable for wide format digital graphics use.

By locating the source of actinic radiation outside the print zone, and by avoiding the use of mobile radiation sources, potentially expensive adaptations to the printing apparatus can be avoided.

Static curing units preferably span the full print width, which is typically at least 1.6 m for the smaller wide format graphics printers. Fluorescent tubes, mercury discharge lamps, and light emitting diodes can be used as static curing units.

Any of the sources of actinic radiation discussed herein may be used for the initial pinning of the inkjet ink. The dose of actinic radiation is lower than the dose required to cure the radiation-curable material fully, namely 1-200 mJ/cm$^2$, preferably 1-100 mJ/cm$^2$, more preferably 1-50 mJ/cm$^2$ and most preferably about 35 mJ/cm$^2$.

The wavelength of the pinning source is typically 200-700 nm, preferably 300-500 nm and most preferably 350-450 nm.

It is preferable to arrest the flow of the ink by pinning the ink droplets quickly after they have impacted on the substrate surface. To achieve a good quality image it is preferable that the inks are pinned within 5 seconds of impact, preferably within 1 second and most preferably within 0.5 seconds. As a result of the pinning, the viscosity of the ink is increased by polymerisation and/or crosslinking of the radiation-curable material thereby arresting the flow of the ink and improving the final image quality.

Following evaporation of the solvent, the composition is exposed to additional actinic radiation. That is, an additional dose of radiation to that required for pinning. The dose required to achieve the final cure will be higher than the pinning dose. The dose provided results in the formation of a solid film. A suitable dose would be greater than 200 mJ/cm$^2$, more preferably at least 300 mJ/cm$^2$ and most preferably at least 500 mJ/cm$^2$. The upper limit is less relevant and will be limited only by the commercial factor that more powerful radiation sources increase cost. A typical upper limit would be 5 J/cm$^2$. The delay between evaporating the solvent and providing a final cure of the ink is less critical than the initial pinning of the ink, but is typically at least 1 minute after jetting.

High and medium pressure mercury discharge lamps can be relatively expensive to operate. The lamp units themselves can be heavy and expensive and often additional shielding is required to prevent unintentional UV exposure to the operator. Extraction is also required to remove ozone that is produced by the lamps. Furthermore, where high discharge currents are involved for high output lamps, electronic ballast is required because the resistance of the gas used in the lamp changes during use. High and medium pressure mercury discharge lamps are not therefore preferred UV sources according to the present invention.

LED sources that are currently available are relatively expensive and a printing apparatus comprising a LED source of UV radiation is unlikely to be suitable for use an entry level printer. Thus, a source of actinic radiation comprising currently available LEDs is not preferred. However, development of UV LED sources for curing inks is ongoing and it is envisaged that the cost of LED sources will decrease significantly in the future. In this case, a printing apparatus according to the present invention that includes a source of actinic radiation comprising LEDs would be suitable for entry level printing systems.

In one embodiment of the invention, the source of radiation comprises a UV fluorescent lamp.

In another embodiment of the invention the source of radiation comprises one or more flash lamps. Flash lamps operate by discharge breakdown of an inert gas, such as xenon or krypton, between two tungsten electrodes. Unlike mercury discharge lamps, flash lamps do not need to operate at high temperature. Flash lamps also have the advantage of switching on instantaneously, with no thermal stabilisation time. The envelope material can also be doped, to prevent the transmission of wavelengths that would generate harmful ozone. Flash lamps are therefore economical to operate and therefore suitable for use in entry level printers.

Flash lamps can be operated in a number of modes, including cold pulse mode and modulation mode. Cold pulse mode is when the lamp output is switched on for a very brief period from fully off every time a flash of UV radiation is required. Normally, the intermittent nature of cold pulsing a flash lamp would exclude its applicability to conventional curing applications, where it is usual to require a constant lamp output. However, when a flash lamp is used to cure the inkjet ink of the present invention downstream from the print zone, the intermittent nature of the cure source does not have a detrimental affect. For example, while the average production speed of a printer for solvent-based inkjet inks is typically 0.5 m/min, the motion of the substrate through the printer actually occurs in steps of 3-6 mm, at the end of each printhead carriage pass. This means that the substrate is static for between 1-3 seconds at a time, which is more than sufficient time for the lamp to flash at high power several times over the same image region in order to cure the ink. Provided that the lamp is triggered in synchronicity with the substrate advancement steps, the pulsed nature of the lamp output is capable of providing sufficient dose and peak irradiance to cure the ink, while not leading to thermal damage of the substrate.

When operating in this mode flash lamps do not emit constant radiation when in use and are therefore "off" for a significant proportion of the time in which the lamp is over the substrate, which reduces the risk of thermally damaging temperature-sensitive substrates.

The circuit elements required to create the voltage pulse to drive the flash lamp are relatively cheap, consisting of an AC-DC converter, high voltage capacitor and inductor. The simplicity and considerably lower average power consumption than the mercury discharge lamp make the capital and running costs for this lamp economical for use in the entry level hybrid solvent/UV printer.

The flash lamp is preferably operated in modulation mode, however. In modulation mode large instantaneous UV power output is achieved during pulses, but the lamp lifetime is extended because repeat triggering of the gas discharge is not required. Modulation also has the benefit that, between pulses, there is relatively low current flowing in the lamp which enhances the infra red (IR) output of the lamp. Since the absolute power between pulses is low, the lamp will act as a low power IR heater that assists with solvent removal from the printed ink.

Flash lamps typically require cooling during use and the maximum average power output of the flash lamp depends on the cooling method used. For higher power outputs, more sophisticated cooling methods are required. If convective air cooling is used the maximum average power output is around 0-15 W/cm$^2$, if forced air cooling is used the maximum average power output is around 15-30 W/cm$^2$ and if water cooling is used the maximum average power output is around 30-60 W/cm$^2$. While it is preferable to maximise the lamp's power output in order to achieve rapid ink curing, when providing an economical source of UV radiation this requirement has to be balanced with the cost of providing an appropriate cooling means. The provision of a recirculating water cooler adds significantly to the cost and is therefore unlikely to be suitable for use in entry level printers. The maximum average power output of the flash lamp is therefore preferably about 30 W/cm$^2$ and the lamp is preferably cooled using a forced air cooling system.

The UV output of the flash lamp can be enhanced compared to the IR output by providing a high current density. This can be achieved by increasing the power output of the lamp. The power output of the lamp is proportional to the lamp's internal diameter and enhancement of the UV output compared to the IR output can therefore be achieved by using a large internal diameter lamp with a large power supply. For example, a lamp internal diameter of around 10 mm would be capable of producing 94 W/cm, compared to 38 W/cm for a 4 mm internal diameter lamp Using a single 1.6 m long flash lamp with an internal diameter of 10 mm would require a power supply capable of providing over 15 kW. Despite the simplicity of construction, a power supply of this magnitude could still be expensive and may need a three phase power connection. The source of radiation is therefore preferably formed from a series of shorter lamps that extend along the print width with a smaller power supply that switches between them. The passage of the printed substrate through printing apparatus is preferably relatively slow and the lamps can therefore be rapidly pulsed in sequence across the full print width before the substrate advances. Since the image quality provided by a hybrid solvent/radiation-curable inkjet ink is thought to be defined by solvent removal stage, the slightly different exposure times experienced by the print across its width are not expected to have an impact on image quality.

Medium pressure mercury lamps are used widely in the printing industry to achieve UV cure of inks designed for a range of applications. Medium pressure mercury lamps are relatively inefficient with typically only 15% of the energy input converted to the desired UV radiation; the remainder of the input energy is converted to infrared radiation/heat and visible light. The high heat output of medium pressure mercury lamps can lead to problems with degradation or distortion of heat sensitive substrates used for some printing applications. One solution is to use dichroic reflectors that channel heat away from the substrate, focussing only the UV radiation onto the material. These however limit the efficacy of the lamp and add considerably to the cost.

Low pressure mercury lamps are much more efficient than medium pressure mercury lamps. Approximately 35% of the energy input is converted to UV radiation, 85% of which has a wavelength of 254 nm (UVC). These lamps therefore generate less heat in use than medium pressure mercury lamps, which means that they are more economical to run and less likely to damage sensitive substrates. Furthermore, low pressure mercury lamps can be manufactured in such a way as not to generate ozone in use and are therefore safer to use than medium pressure mercury lamps.

Although low pressure mercury lamps are used extensively in the water purification industry, they have not yet found widespread application in the printing industry. Typical medium pressure mercury lamps have an output in the range of 80 to 240 W/cm. In contrast, the maximum output for low pressure mercury lamps is around 30 to 440 mW/cm, which means that the peak irradiance of low pressure mercury lamps is also low. The low power output and low peak irradiance of these lamps suggests that they would not provide effective curing of radiation-curable inkjet inks.

A single low pressure mercury lamp or two or more low pressure mercury lamps can be used.

The IUPAC Compendium of Chemical Terminology (PAC, 2007, 79, 293 "Glossary of terms used in photochemistry", 3rd edition (IUPAC Recommendations 2006), doi: 10.1351/pac200779030293) describes a low pressure mercury lamp as a: "resonance lamp that contains mercury vapour at pressures of about 0.1 Pa ($0.75\times10^{-3}$ Torr; 1 Torr=133.3 Pa). At 25° C., such a lamp emits mainly at 253.7 and 184.9 nm. They are also called germicidal lamps. There are cold- and hot-cathode as well as cooled electrodeless (excited by microwaves) low-pressure mercury lamps. The Wood lamp is a low-pressure mercury arc with an added fluorescent layer that emits in the UV-A spectral region (315-400 nm)."

Low pressure mercury lamps predominantly emit UV radiation with a peak wavelength of around 254 nm but the wavelength of the radiation can be varied by coating the internal surface of the lamp with a phosphor. In a preferred embodiment of the lamp, there is no such phosphor coating. In the method of the present invention the lamp preferably emits radiation with a peak wavelength of around 254 nm, or put another way, the natural or unaltered wavelength of radiation emitted by mercury vapour in a low pressure lamp environment.

The use of a phosphor coating can lead to a reduction in lamp luminous efficiency. The preferred phosphor-free lamps used according to the invention have an efficiency exceeding 45% for UVC generation, however. This high efficiency helps to minimise the cure unit running costs.

In low pressure mercury lamps the UV output varies with temperature. When the lamp is first switched on the liquid mercury starts to vaporise and as the temperature increases, the vapour pressure of the mercury reaches an optimum level and the output of UVC radiation reaches a maximum. As the temperature of the lamp increases further the vapour pressure continues to rise, reducing the UVC output. Low pressure mercury lamps are therefore operated at an optimum temperature at which maximum UVC output can be achieved and this temperature is typically around 25-40° C. for standard low pressure lamps. This limit on the operating temperature limits the energy input, however, because the lamp temperature can be raised above the optimum temperature if the energy input is too high. Limiting the energy input limits the maximum UV output achievable. The maximum UV output achievable from a low pressure mercury lamp is therefore limited by the operating temperature and the energy input. Standard low pressure mercury lamps have linear power densities of less than 380 mW/cm in their normal configuration. However, U shaped lamps can have effective total power densities of up to twice this, for example 650 mW/cm.

Although the UVC output of standard low pressure mercury lamps is sufficient to cure the inks of the current invention within an acceptable time frame, the UVC cure dose is preferably delivered over a shorter time period, allowing faster cure speeds.

The low pressure mercury lamp may be an amalgam lamp. In amalgam lamps an amalgam of mercury, typically with bismuth and/or indium, is used instead of liquid mercury. Other suitable materials that are compatible with, or are capable of forming an amalgam with mercury could be used instead of bismuth or indium, however. Amalgam lamps have the same spectral output as conventional low pressure mercury lamps. In operation, the amalgam gradually releases mercury vapour as the temperature increases, but vapour is reabsorbed if the pressure becomes too high. This self-regulation means that the optimum mercury vapour pressure is achieved at a higher temperature, approximately 80-160° C., for example 83° C., depending on the type of lamp and manufacturer. Amalgam lamps therefore operate at a higher optimum temperature than standard low pressure mercury lamps, which means that higher energy inputs can be tolerated. A higher energy input leads to an accompanying increase in UVC output, which remains stable during extended operation of the lamp.

Typically, amalgam lamps can run at temperatures up to 140° C. with linear power densities exceeding 380 mW/cm and such lamps can achieve outputs that equate to approximately five times the output of a conventional low pressure mercury lamp. The combination of the increased radiation and heat generated by the amalgam lamp offers a useful advantage in drying and curing the inks used in the present invention when compared to regular low pressure mercury lamps.

In an embodiment of the invention the cure lamp linear power density is below 2,000 mW/cm, preferably 200 mW/cm to 1500 mW/cm, more preferably 380 mW/cm to 1,500 mW/cm. In a more preferred embodiment the linear power density is 380 mW/cm to 1,200 mW/cm and in a most preferred embodiments either 380 to 1,000 mW/cm or 500 to 1,000 mW/cm. Standard low pressure mercury lamps have current densities not exceeding 0.45 Amps/cm whereas amalgam lamps have current densities above this level.

The temperature of the amalgam lamp may be controlled in order to allow the optimal UV light output to be maintained. Temperature control can be achieved by immersing the lamp in water within a quartz sleeve. As well as providing electrical insulation against the water, the air gap around the lamp prevents overcooling by the water. By controlling the water flow past the lamps, the optimal lamp temperature can be maintained for maximum UV output. While convenient, this method is not preferred as it incurs the additional cost of a chiller.

In a preferred embodiment air is blown across the low pressure mercury lamp(s) to control the lamp temperature. In a further preferred embodiment, forced air that has been warmed by the lamp(s) is directed over the surface of the printed image to aid removal of the solvent prior to curing. For example, one or more fans can be positioned at the rear of the lamp reflector in order to extract and transport excess warm air upstream in the print process to assist in drying and pinning the printed image, thus increasing efficiency of the printer.

The low pressure mercury lamp is preferably used together with auxiliary ballast electronics in order to regulate the current through the lamp. Many types of ballast are available. Preferred for use in this invention are electronic ballasts that convert input mains frequency to frequencies greater than the relaxation time of the ionised plasma in the lamp, thereby maintaining optimal light output.

In a more preferred embodiment, an electronic ballast operating in rapid or instant start mode is provided wherein electrodes of the low pressure mercury lamp may be pre-warmed before ignition in order to reduce electrode damage caused by frequent switching. Though more expensive to implement than cold-start methods, pre-heating is preferred because the preferred amalgam lamp of the present invention is high power, operates at high temperature and in use is likely to be frequently switched.

Low pressure mercury lamps emit light in all directions. For efficient UV curing of printed images, the lamp is therefore preferably used in conjunction with at least one reflector to ensure that the majority of emitted UV light is efficiently directed to the printed surface. The reflector is preferably made of a material that efficiently reflects the UV light with minimal loss, for example aluminium, which has a reflective efficiency of greater than 80%. To prevent hazing of the mirror finish during long term UV exposure, pre-anodised aluminium is preferred, such as 320G available from Alanod. This material is easily formed into curved or faceted shapes by rolling or bending to provide efficient reflectors.

Figure 4:
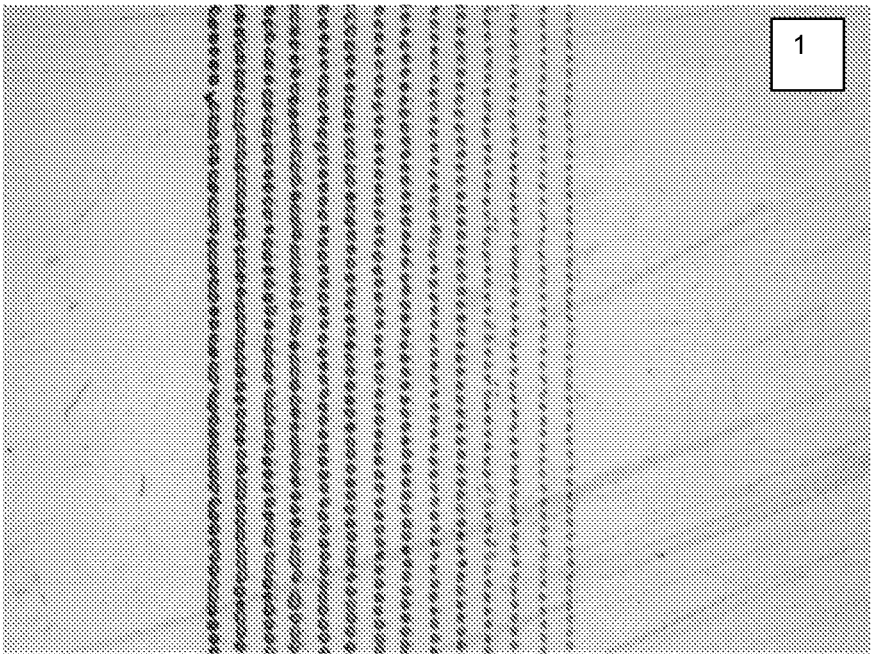
FIGS. 4-10 show images printed using the method of the present invention (as set out in Example 3).
Figure 5:
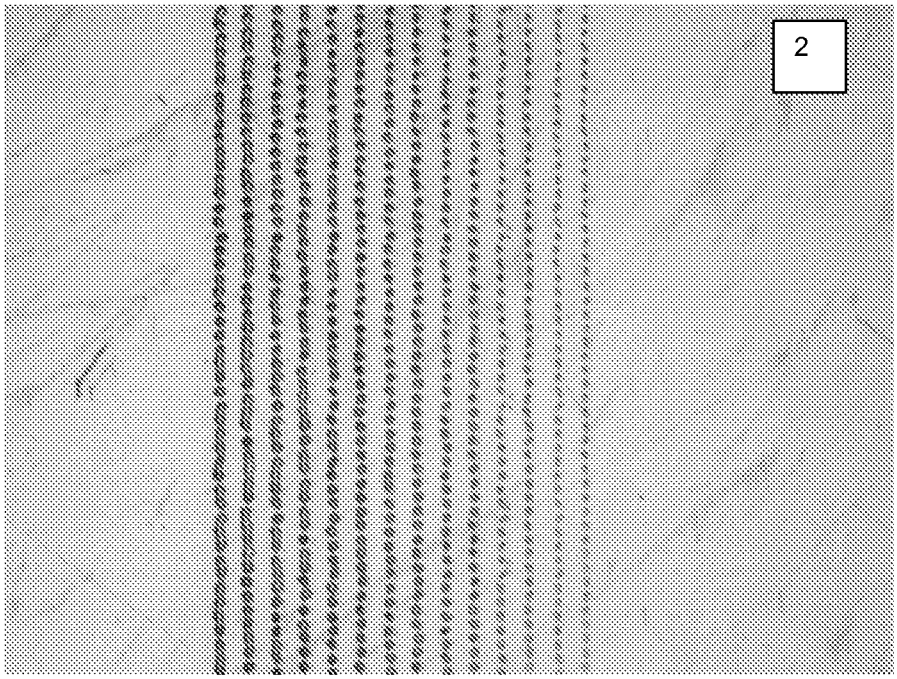
Figure 6:
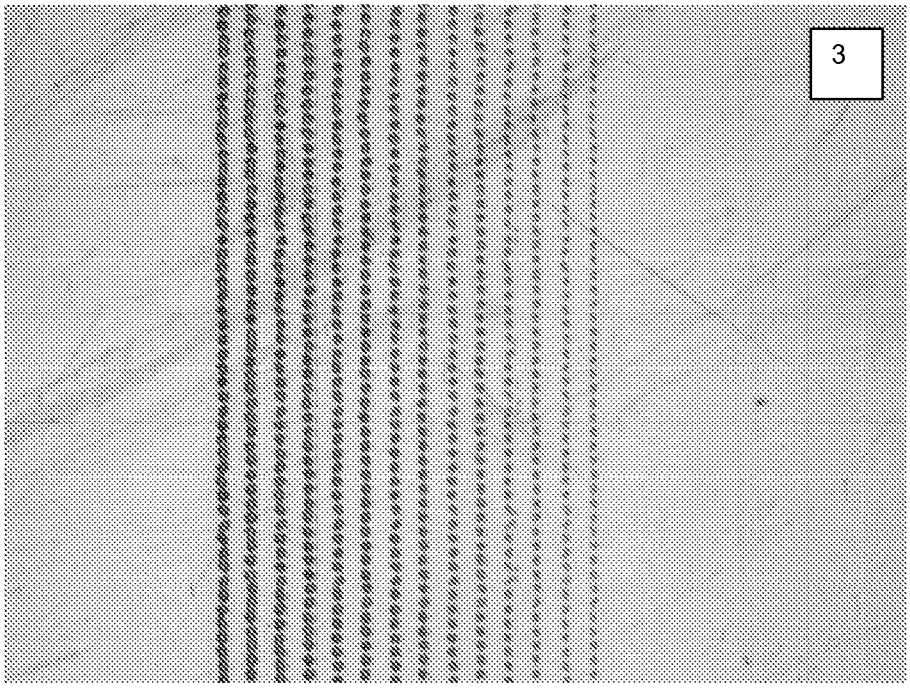
Figure 7:
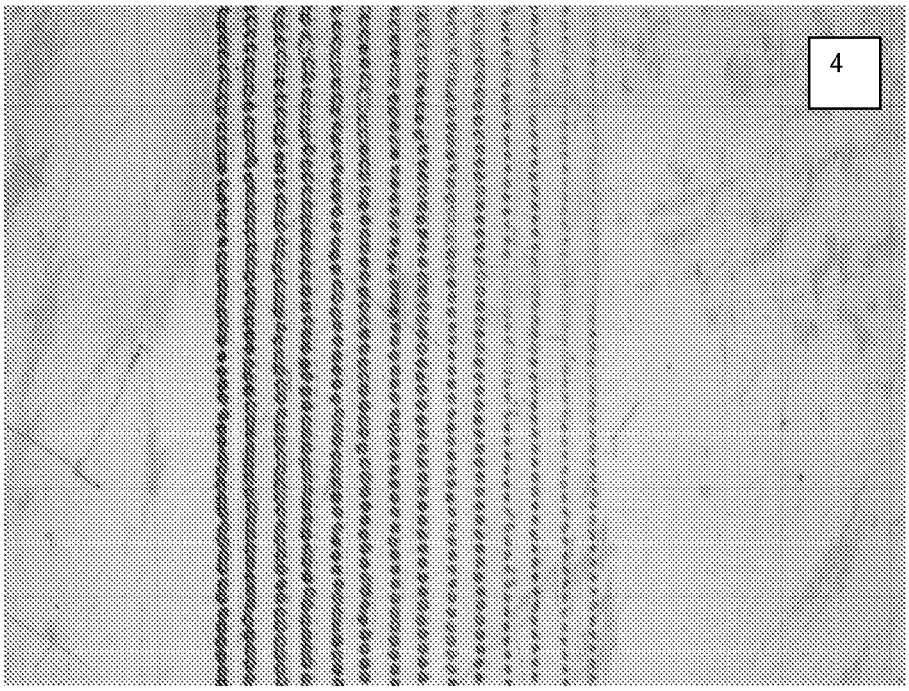
Figure 8:
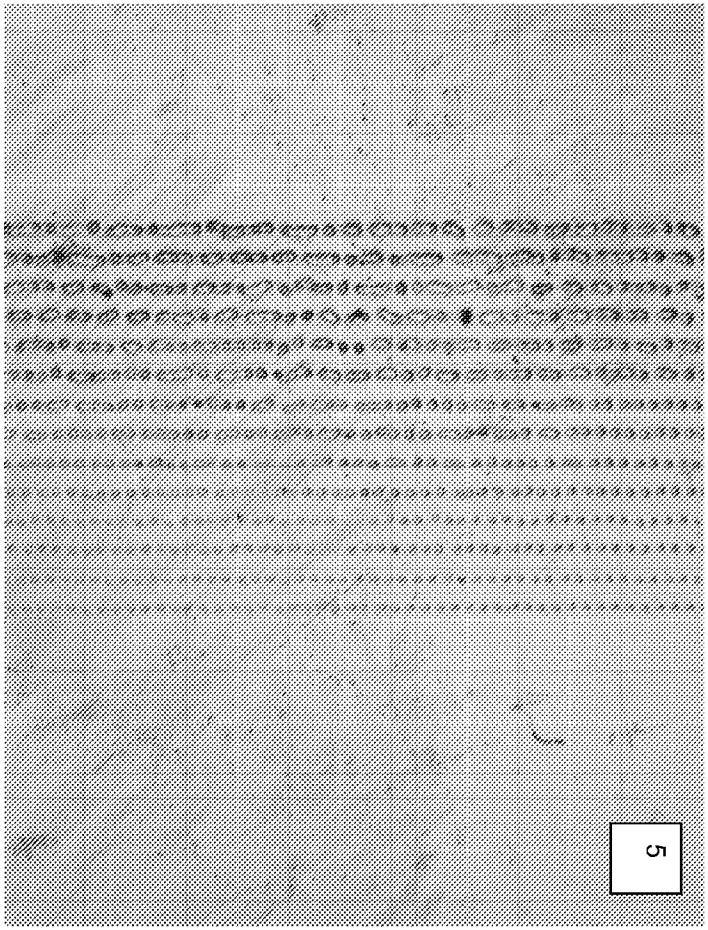
Figure 9:
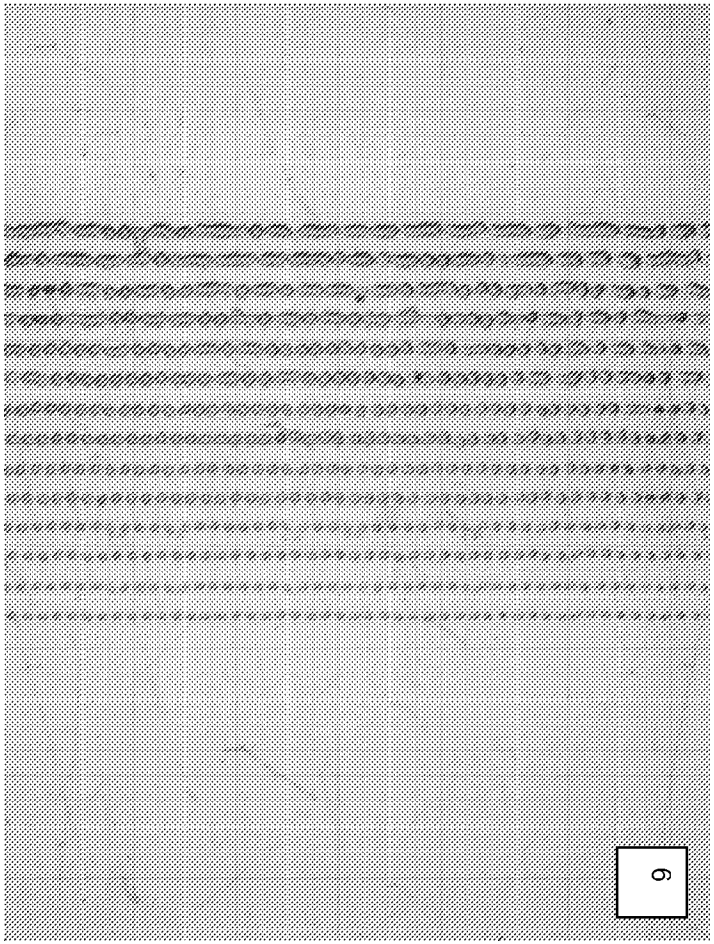
Figure 10:
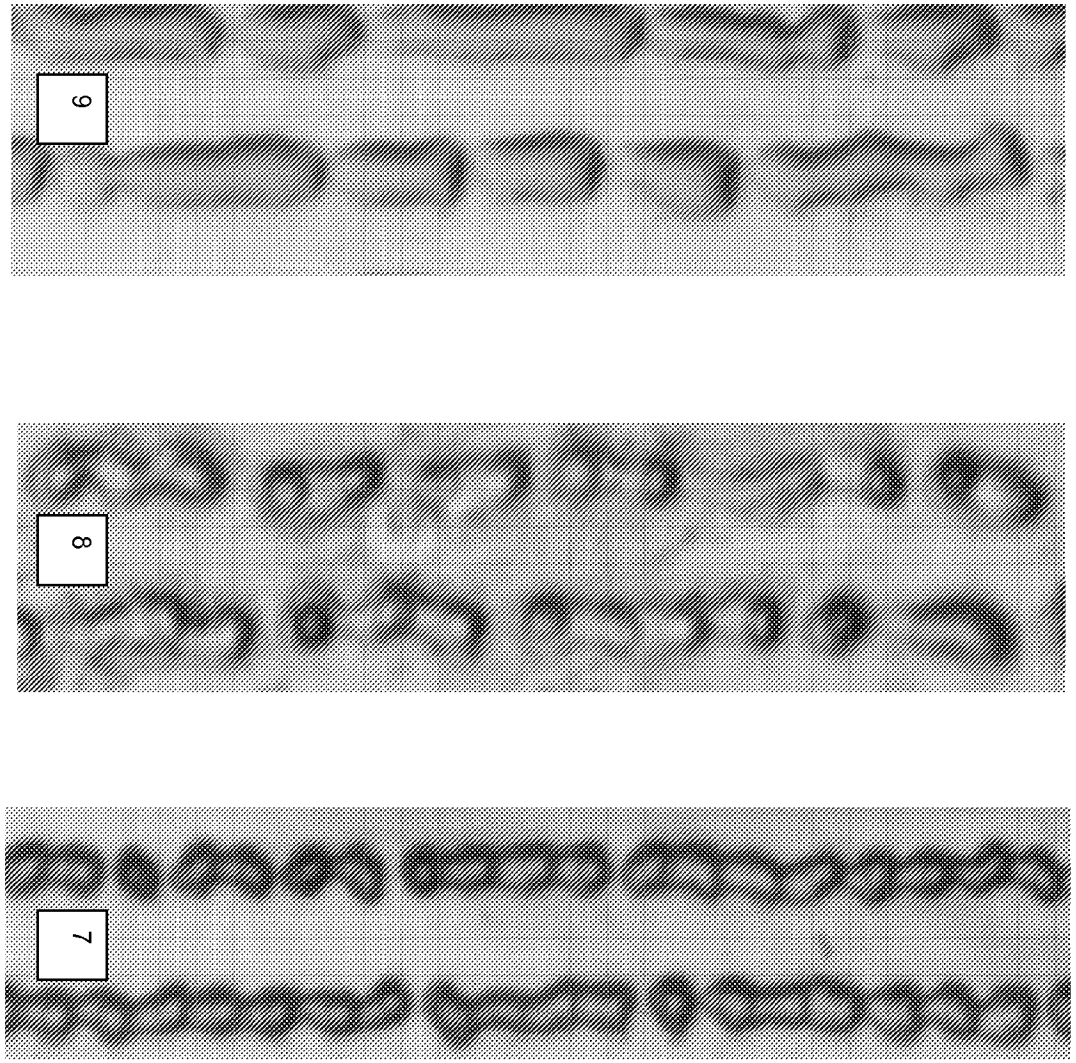

In one embodiment the reflector preferably has an elliptical shape such that the radiation directed at the printed substrate is focussed to a narrow line, thereby increasing the peak irradiance at the printed substrate. "Elliptical reflector" is a term known in the art and refers to a reflector having a general shape as shown in FIG. 4.

The finite diameter of the low pressure mercury lamp prevents all of the emitted light from originating at the focus of the ellipse. In a preferred embodiment low pressure mercury lamps with diameter below 30 mm, preferably below 20 mm and more preferably below 10 mm are therefore used in combination with an elliptical reflector, in order to increase the peak irradiance at the substrate even further.

In one embodiment, the bulb of the low pressure mercury lamp is partially coated with a reflective coating such that the radiation produced by the bulb is directed towards the print surface. The reflective material can be any material that reflects UVC radiation, and the coating can be can be applied by painting or vacuum deposition, for example.

The total UV dose received by the ink printed on the substrate is inversely proportional to the speed that the substrate moves past the lamp. Although the low pressure mercury lamps used according to the preferred embodiment of the present invention have a relatively low power output when compared to medium pressure mercury lamps, the use of a static lamp allows the printed ink to be exposed to the radiation from the lamp for longer periods than are achieved with traditional scanning type large format printers. Hence, the total dose provided by the low pressure lamps can exceed that provided by scanning type cure units using higher output lamps.

The envelope of a low pressure mercury lamp is typically made from fused quartz, which allows production of lamps with lengths exceeding one meter. To ensure even curing across the full print width using a static in-line cure unit, it is preferable to provide a lamp with an arc length exceeding the print width by several centimeters to counter the emission variance near the electrodes. Together with the electrode encapsulation, the final lamp length could approach 3 m in some cases. This length of lamp is achievable for envelopes with a wide diameter. However, narrower lamps would be more fragile and require additional support along their length, which could interfere with the irradiance profile. In this case, it may be preferable to use several smaller lamps in a castellated or staggered arrangement to achieve full width curing.

The invention will now be described with reference to the following examples, which are not intended to be limiting.

EXAMPLES

Example 1

Inkjet inks were prepared according to the formulations set out in Table 1. The inkjet ink formulations were prepared by mixing the components in the given amounts. Amounts are given as weight percentages based on the total weight of the ink.

TABLE 1

| Component | Cyan ink (ink 1) | Magenta ink (ink 2) | Yellow ink (ink 3) | Black (ink 4) |
|---|---|---|---|---|
| Gamma butyrolactone | 16.3 | 15.5 | 15.6 | 16.5 |
| Diethylene glycol diethyl ether | 53.1 | 51.7 | 52.4 | 51.4 |
| Nippon Goshei UV7630B | 18.0 | 15.0 | 12.0 | 19.5 |
| Cyan pigment dispersion | 6.0 | — | — | — |
| Magenta pigment dispersion | — | 11.2 | — | — |
| Yellow pigment dispersion | — | — | 13.4 | — |
| Black pigment dispersion | — | — | — | 6.0 |
| Irgacure 819 | 4.0 | 4.0 | 4.0 | 4.0 |
| Irgacure 2959 | 2.0 | 2.0 | 2.0 | 2.0 |
| UV 12 stabilizer | 0.5 | 0.5 | 0.5 | 0.5 |
| Byk331 | 0.1 | 0.1 | 0.1 | 0.1 |

Gamma butyrolactone and diethylene glycol diethyl ether are organic solvents. Nippon Gohsei 7630B is a hexafunctional urethane acrylate oligomer with a viscosity of 6.9 Pa·s at 60° C.

The cyan pigment dispersion is composed of Disperbyk 168 (20.0 wt %) as a dispersing agent, Rapicure DVE3 (50.0 wt %) which is triethylene glycol divinyl ether and Irgalite blue GLVO (30.0 wt %) which is the pigment. The magenta, yellow and black pigment dispersions are analogous although the pigments are clearly different colours.

Irgacure 819 and Irgacure 2959 are free-radical photoinitiators. UV 12 is a stabiliser and BYK 331 is a polyether modified polydimethylsiloxane and reduces surface tension.

Example 2

A 220 micron gloss PVC and a coated clear gloss polyester film were selected as test substrates since both of these materials had been found to be non-receptive to solvents in the above inkjet ink compositions and thus had slow pinning responses.

Then, 12 micron (wet) films of the inks from Example 1 were cast onto the test substrates using a No. 2 K-bar applicator. The wet films were exposed to a 395 nm UV LED source suspended over a conveyor running at a speed of 20 m/min at a distance of 3 mm. The 395 nm LED was supplied by Nordson and had a nominal power of 10 W (at the array surface).

After exposure the prints were assessed for signs of physical changes typically associated with a curing process, principally the surface skinning viscosity increase. The changes are assessed by dragging a spatula through the ink film and recording any changes to the nature of the film and thereby determining whether or not partial cure has been achieved. The power of the LED was reduced in stages until no change to the film was evident after exposure. The results are set out in Tables 2-5.

TABLE 2

| Cyan ink (ink 1) | | |
|---|---|---|
| LED Power (%) | 220 micron gloss PVC Substrate | Coated Polyester Substrate |
| 50 | Partial cure | Partial cure |
| 40 | Partial cure | Partial cure |

TABLE 2-continued

| Cyan ink (ink 1) | | |
|---|---|---|
| LED Power (%) | 220 micron gloss PVC Substrate | Coated Polyester Substrate |
| 30 | Partial cure | Partial cure |
| 20 | Partial cure | Partial cure |
| 10 | Partial cure | Partial cure |
| 5 | Partial cure | Partial cure |
| 2.5 | Partial cure | Partial cure |

TABLE 3

| Magenta ink (ink 2) | | |
|---|---|---|
| LED Power (%) | 220 micron gloss PVC Substrate | Coated Polyester Substrate |
| 50 | Partial cure | Partial cure |
| 40 | Partial cure | Partial cure |
| 30 | Partial cure | Partial cure |
| 20 | Partial cure | Partial cure |
| 10 | Partial cure | Partial cure |

TABLE 3-continued

| Magenta ink (ink 2) | | |
|---|---|---|
| LED Power (%) | 220 micron gloss PVC Substrate | Coated Polyester Substrate |
| 5 | Partial cure | Partial cure |
| 2.5 | Partial cure | Partial cure |

TABLE 4

| Yellow ink (ink 3) | | |
|---|---|---|
| LED Power (%) | 220 micron gloss PVC Substrate | Coated Polyester Substrate |
| 50 | Partial cure | Partial cure |
| 40 | Partial cure | Partial cure |
| 30 | Partial cure | Partial cure |
| 20 | Partial cure | Partial cure |
| 10 | Partial cure | Partial cure |
| 5 | Film unchanged | Film unchanged |
| 2.5 | — | — |

TABLE 5

| Black ink (ink 4) | | |
|---|---|---|
| LED Power (%) | 220 micron gloss PVC Substrate | Coated Polyester Substrate |
| 50 | Partial cure | Partial cure |
| 40 | Partial cure | Partial cure |
| 30 | Partial cure | Partial cure |
| 20 | Partial cure | Partial cure |
| 10 | Partial cure | Partial cure |
| 5 | Film unchanged | Film unchanged |
| 2.5 | — | — |

These results show that partial film cure is still evident in the cast films even at low LED power. The cyan and magenta inks showed evidence of physical changes after exposure even at 2.5% of the full LED power. The yellow and black inks, whilst less reactive, still, showed evidence of physical changes after exposure to the LED running at 1/10th of full power.

The intensity and dose of UV light was measured at a range of LED power settings using a Power puck 2 supplied by EIT. A summary of the findings is set out in Tables 6 and 7.

TABLE 6

| | Power | | | | | | | | | |
|---|---|---|---|---|---|---|---|---|---|---|
| | 100% | | 20% | | 10% | | 5% | | 2.5% | |
| | Dose ($mJ/cm^2$) | Intensity ($mW/cm^2$) | Dose ($mJ/cm^2$) | Intensity ($mW/cm^2$) | Dose ($mJ/cm^2$) | Intensity ($mW/cm^2$) | Dose ($mJ/cm^2$) | Intensity ($mW/cm^2$) | Dose ($mJ/cm^2$) | Intensity ($mW/cm^2$) |
| UVA | 15.390 | 222.907 | 2.68 | 45.703 | 1.040 | 21.870 | 0.034 | 7.851 | 0.000 | 0.000 |
| UVB | 0.000 | 0.000 | 0.000 | 0.000 | 0.000 | 0.000 | 0.000 | 0.000 | 0.000 | 0.000 |
| UVA2 | 196.425 | 2632.979 | 43.146 | 603.978 | 23.392 | 339.075 | 12.367 | 170.715 | 6.166 | 91.833 |
| UVV | 300.448 | 4008.850 | 66.638 | 903.324 | 35.749 | 495.076 | 18.716 | 250.839 | 9.077 | 130.497 |

TABLE 7

| The wavelengths of the UV radiation. | | |
|---|---|---|
| Designation | Minimum wavelength (nm) | Maximum wavelength (nm) |
| UVA2 | 375 | 415 |
| UVB | 280 | 320 |
| UVC | 250 | 260 |
| UVV | 395 | 445 |

These data show that the inks respond to very low doses of UV light at 395 nm without the need for solvent removal, still showing evidence of physical change at low dose and light intensity. When running at full power the LED used requires water cooling which adds considerably to the complexity and cost of printer. A low power LED system will not require this expensive cooling and that the physical changes produced by the low UV doses are sufficient to pin the ink droplets of the ink on the substrate surface preventing bleed and excessive dot spread on non receptive substrates.

Example 3

Ink 1 as set out in Table 1 hereinabove was used to evaluate the effect on image quality when the ink was exposed to various levels of UV light from a 395 nm UV LED prior to removal of the solvent.

This example used: a test printer rig fitted with a Xaar 1001 printhead and ink supply (theoretical drop range, 42 to 6 nanograms in 6 nanogram units); a Phoseon 395 nm 4 W UV LED source; a XY translation table; a monochrome digital camera fitted with an extension tube; and a power puck 2 supplied by EIT (see Table 7 for the output from the channels).

The ink was printed onto a 220 micron Genotherm (gloss rigid PVC) substrate supplied by Klöckner-Pentaplast GmbH (a non-receptive material). Seven rows of droplets were deposited, two of each size, producing 14 rows of drops with the theoretical drop size decreasing from left to right. The ink was jetted in the array of drops described hereinabove to form a 180×180 dpi test pattern on to the substrate. After deposition of this first array of drops the test print was exposed to a range of UV doses from the LED source. The data from the UVA2 channel were used as this is the closest match to the 395 nm output of the Phoseon 395 nm LED.

The UV exposure was as follows.

LED distance from substrate surface: 10 mm

Effective LED linear speed over image: 200 mm/s

LED array distance from head: 10 cm

Drop residence time on substrate before pinning: 0.5 seconds

The results are set out in Table 8.

TABLE 8

| UV dose ($mJ/cm^2$) | Intensity ($mW/cm^2$) | Image number (see FIGS. 4-10) |
|---|---|---|
| 226.8 | 1577.25 | 1 |
| 171.73 | 1219.3 | 2 |
| 109.75 | 779 | 3 |
| 54.45 | 385.3 | 4 (and 7) |
| 29.57 | 203.68 | 5 (and 8) |
| 0 | 0 | 6 (and 9) |

After the deposition and pinning of the first array of droplets a second array was deposited that was offset by half a nozzle pitch (70 microns) in the Y direction. This effectively produced a final array of drops 180×360 dpi where drops were deposited between the previously pinned drops.

It is possible to assess the effectiveness of the UV pinning process by visual inspection of the images captured, the first areas of the array to show droplet spreading and merging as the UV pinning does is reduced are the pair of rows employing the largest drop mass.

Looking more closely at these areas, images 8 and 9, which correspond to the top left hand sections of images 5 and 6, respectively, it is clear that the exposure to a pinning dose of 29.57 $mJ/cm^2$ has reduced the merging of adjacent droplets and would hence produce a higher-quality printed image with reduced ink pooling and inter-colour bleed.

Image 7 similarly shows the effect of increasing the pinning dose where the flow of the droplets has been further restricted, but care is needed to avoid over pinning the droplets as this can lead to an a deterioration of the image quality, for example in solid colour areas of a print, where a degree of drop spread is required to give full coverage of the ink on the substrate.

Image 1 corresponds to the full power setting of the LED. This dose results in an over pinning the image which traps solvent in the film before the thermal drying stage leading to bloom or a hazy appearance. A further problem with image quality also results because an insufficient degree of drop spread may prevent full coverage of the substrate leading to the substrate showing behind the image.

What is claimed is:

1. A method of inkjet printing comprising the following steps, in order:

(i) providing a hybrid inkjet ink comprising an organic solvent, a radiation-curable material, a photoinitiator and optionally a colorant;

(ii) printing the ink on to a substrate;

(iii) pinning the ink by exposing the ink to actinic radiation at a dose of 1-200 $mJ/cm^2$, and wherein said actinic radiation does not fully cure said ink;

(iv) evaporating at least a portion of the solvent from the ink; and (v) exposing the ink to additional actinic radiation to cure the ink.

2. A method as claimed in claim 1, wherein ink comprises at least 30% by weight of organic solvent based on the total weight of the ink.

3. A method as claimed in claim 1, wherein the ink comprises less than 5% by weight of water based on the total weight of the ink.

4. A method as claimed in claim 1, wherein the radiation-curable material is present in an amount of 2 to 65% by weight based on the total weight of the ink.

5. A method as claimed in claim 1, wherein the radiation-curable material comprises a radiation-curable oligomer.

6. A method as claimed in claim 1, wherein the ink contains less than 20% by weight of radiation-curable material having a molecular weight of less than 450, based on the total weight of the ink.

7. A method as claimed in claim 1, wherein the photoinitiator is a radical photoinitiator.

8. A method as claimed in claim 1, wherein the inkjet ink is a component of an inkjet ink set.

9. A method as claimed in claim 1, wherein the inkjet ink is printed using a piezo drop-on-demand printhead.

10. A method as claimed in claim 1, wherein the source of actinic radiation is a UV source selected from a mercury discharge lamp, an LED, a flash lamp, a UV fluorescent lamp and combinations thereof.

11. A method as claimed in claim 1, wherein the ink is jetted at less than 35° C.

12. A method as claimed in claim 1, wherein, in step (iii), the dose is 1-100 $mJ/cm^2$.

13. A method as claimed in claim 1, wherein step (iii) is initiated within 5 seconds of impact of the ink onto the substrate.

14. A method as claimed in claim 1, wherein the solvent is evaporated by heating the printed ink.

15. A method as claimed in claim 1, wherein the printing is performed on a roll-to-roll printer or flat-bed printer.

* * * * *